US007854662B2

(12) United States Patent
Braun et al.

(10) Patent No.: US 7,854,662 B2
(45) Date of Patent: Dec. 21, 2010

(54) WATER SLIDE

(75) Inventors: Rainer Braun, Magstadt (DE); Manfred Schmudermayer, Grossweikersdorf (AT)

(73) Assignee: Aquarena Freizeitanlagen GmbH, Krems-Stein (AT)

( * ) Notice: Subject to any disclaimer, the term of this patent is extended or adjusted under 35 U.S.C. 154(b) by 491 days.

(21) Appl. No.: 11/999,203

(22) Filed: Dec. 4, 2007

(65) Prior Publication Data

US 2008/0153610 A1 Jun. 26, 2008

(30) Foreign Application Priority Data

Dec. 22, 2006 (DE) ..... 10 2006 062 349

(51) Int. Cl.
*A63G 21/18* (2006.01)
*A63G 21/00* (2006.01)

(52) U.S. Cl. ..... 472/117; 472/116; 472/128

(58) Field of Classification Search ..... 472/13, 472/116, 117, 128, 129; 104/53, 69, 70
See application file for complete search history.

(56) References Cited

U.S. PATENT DOCUMENTS 4,149,710 A 4/1979 Rouchard
4,910,814 A * 3/1990 Weiner ..... 4/488
5,433,671 A * 7/1995 Davis ..... 472/117
6,342,014 B1 * 1/2002 Lynch ..... 472/70
6,527,646 B1 * 3/2003 Briggs ..... 472/117
6,569,023 B1 * 5/2003 Briggs ..... 472/117
6,743,107 B2 * 6/2004 Dubeta ..... 472/116
7,048,092 B2 * 5/2006 Gomes Junior ..... 182/48
2004/0198520 A1 10/2004 Hlynka

FOREIGN PATENT DOCUMENTS

DE 39 35 061 A1 4/1991
DE 198 39 048 A1 3/2000
DE 201 20 561 U1 3/2002
DE 20 2004 011 534 U1 11/2004
DE 20 2006 014 776 U1 1/2007

OTHER PUBLICATIONS

Printout of entry for "Action Park" from www.wikipedia.org from at least as early as Nov. 26, 2008.

* cited by examiner

*Primary Examiner*—Kien T Nguyen
(74) *Attorney, Agent, or Firm*—Kriegsman & Kriegsman

(57) ABSTRACT

Water slide with a chute which opens into a discharge area and has an initial section and a discharge section opening into the discharge area, characterized in that at least one loop section is provided between the initial section and the discharge section, the loop section having an angle at circumference of at least 270° and, at least between a starting point and an apex point of the loop section, being inclined by 5° to 80° in relation to a vertical.

20 Claims, 4 Drawing Sheets

WATER SLIDE

BACKGROUND OF THE INVENTION

The invention relates to a water slide with a chute which opens into a discharge area and comprises an initial section and a discharge section opening into the discharge area.

Ever greater demands are being imposed on attractions at leisure facilities. For example, water chutes which are designed as black-hole slides, as wide chutes and as high-speed water chutes are provided in water parks or adventure parks. Furthermore, a water slide with a take-off ramp has already been developed and disclosed in DE 201 20 561 U1.

Furthermore, a water chute has been disclosed which has a very long and steep initial section which merges into a loop section, the starting point of the loop and the end of the loop being situated directly adjacent to each other and orienting the loop section vertically. Such a looping-the-loop chute has the disadvantage of the accelerations which occur being excessive and of the users suffering injuries in the region of the neck and spine and also briefly experiencing considerable disturbances of equilibrium after using the looping-the-loop chute. However, the configuration of a loop section to loop the loop without the abovementioned disadvantages could considerably increase the thrill.

SUMMARY OF THE INVENTION

The invention is therefore based on the object of providing a water slide with a chute which opens into a discharge area and comprises a loop section which permits sliding upside down and in which the loads to which the human body is subjected lie below the maximum permissible acceleration force of a standard established for water slides.

This object is achieved according to the invention by the features of Claim 1. Further advantageous configurations and developments of the invention are indicated in the further claims.

The configuration according to the invention of the water slide has a loop section which comprises at least one angle at circumference of at least 270°, as seen from a starting point of the loop section, and which, at least between a starting point and an apex point of the loop section, is inclined by at least 5° to 80° in relation to a vertical or has a transverse inclination. The orientation of the loop section outside a vertical enables the maximum acceleration during the transition from the starting point into the rising section portion of the loop section to be reduced, and therefore the loading due to the acceleration and centrifugal forces does not lead to the user suffering physical impairment. In order to reduce the physical loadings, the angle of inclination of the loop section in relation to the vertical can be increased, with, even at a very large angle of inclination in relation to the vertical, the user being given the sensation of travelling upside down. Furthermore, this arrangement has the advantage that, while the initial section remains the same length, the arrangement can be used both by light and heavy individuals. The inclined arrangement makes it possible for users who slide more slowly or for very light users to experience a roller coaster-type ride rather than travelling upside down.

According to a further preferred configuration of the invention, it is provided that the radius of curvature of the loop section decreases from the starting point of the loop section to the apex point of the loop section. The starting point of the loop section preferably constitutes the transition from a falling profile of the initial section into a rising profile of the loop section. Subsequently thereto, the radius of curvature of the loop section decreases, and therefore the reduction in the sliding speed that results because of gravity is compensated for by a reduction in the radius of the loop section as far as the apex point so as not to reduce the centrifugal force or to reduce it only by a small amount such that the apex point is slid through or travelled through at the required minimum speed. It is preferably provided that the decrease in the radius of the loop section results in a constant centrifugal force acceleration which is preferably smaller than or equal to the permissible acceleration.

According to a first alternative embodiment, it is provided that the radius of curvature is decreased continuously between the starting point and the apex point of the loop section. The loop section comprises a plurality of individual chute segments. These are matched to the decrease in the radius of curvature in accordance with the size of the circular arc segment. Such a configuration obtains a very uniform lateral acceleration.

According to an alternative configuration of the invention, it is provided that the radius of curvature is decreased in some sections between the starting point and the apex point of the loop section. The sectional reduction in the radius of curvature takes place from chute segment to chute segment of which the loop section is composed. Simple production of the individual chute segments can be obtained as a result, since they have a constant radius over their angular region. Production can thereby also be obtained on account of the section between the starting point to the apex point, firstly, and from the apex point to the discharge point, secondly, having identical parts.

A radius of curvature is preferably provided for a chute profile from the starting point as far as the apex point, which radius of curvature is formed from a combination of a chute profile for circular looping the loop and clothoid looping the loop. This ensures that a uniform lateral acceleration is obtained for the user, with the centrifugal accelerations acting in this case being smaller than or equal to the permissible accelerations. For example, the combination of both forms of looping the loop makes it possible for the high accelerations which occur directly after the starting point in the case of circular looping the loop to be considerably reduced and for the accelerations which are too low in the case of pure clothoid looping the loop, for example at an angle of 90°, 135°, 180° and 225°, to be increased such that a centrifugal force of greater than or equal to 1 g [$m/s^2$] acts on the user and the user is prevented from lifting off from the sliding surface, a centrifugal force of less than 1 g being uncritical in some chute portions if the sliding speed is sufficiently high.

According to a further preferred configuration, it is provided that the loop section from the apex point to the discharge point is designed in a mirror-inverted manner with respect to the chute profile from the starting point to the apex point. As a result, not only can a simple construction be obtained by means of identical parts, but also identical lateral accelerations can be provided for each sector within the loop section, which provide an improve sliding sensation for the user.

In order to reduce the acceleration forces during sliding in the loop section, the chute profile comprises a minimum radius of 2 m from a chute base at the starting point as far as the apex point of the loop section. This makes it possible to ensure that excessive accelerations which would lead to the user being injured do not occur.

According to a further preferred configuration of the invention, it is provided that the chute is completely closed at least along the loop section. A secure loop section with a chute running upside down can thereby be provided. This closed arrangement of the loop section can take place from different materials. For example, part of the tubular loop section may be completely transparent. Furthermore, tube sections which, although they let in daylight, do not open up a view of the surroundings, may also be provided.

A further preferred embodiment of the water slide provides that the chute is of circular design, as seen in cross section. This makes it possible for consistent conditions to be created for individuals of differing weight in order for them to pass through the loop section.

A further alternative embodiment for the configuration of the geometry of the sliding surface provides that the chute comprises a sliding surface with a profile which is provided for guiding the sliding individual. Starting from, for example, a circular cross section of the chute, lateral guide profiles can be fitted onto the sliding surface, thus predetermining the sliding path. As a result, high sliding speeds can be obtained and undesirable oscillating movements of the sliding individual can be avoided. As an alternative to guide profiles which are fitted onto or incorporated into the sliding surface, the guide profile may be formed by a depression in the sliding surface, which depression is superimposed on the circular cross section of the chute. The same effect is thereby obtained. Lateral guide profiles of this type may be provided in some sections or completely along a chute. The lateral guide profiles may also be used for and adapted to further cross sections of the chutes in a departure from the circular cross section.

According to a further alternative configuration of the invention, it can be provided that a sliding surface of the chute has a trough-shaped depression, as seen in cross section. This enables the sliding individual to be fully guided as he slides down the water slide. The trough-shaped depression in the loop section is preferably designed in such a manner that the lowest point of the trough-shaped depression is situated in the directional vector of the maximum effective acceleration force of a sliding individual.

According to a further alternative embodiment of the invention, it is provided that a sliding surface of the chute has a rectilinear sliding surface, as seen in cross section, which is adjoined laterally by lateral guiding walls in order to bound the sliding surface. An alternative embodiment of this type makes it possible for, for example, two individuals to slide next to each other through a loop section.

The sliding surface of the chute is preferably at least partially acted upon by a water film, rainfall or spray mist along the loop section, and therefore a liquid sliding film is maintained over the entire chute, in particular the upside down region of the loop section.

So that an accumulation of water is prevented at the starting point of the loop section, a water outlet region is preferably integrated in the sliding surface. This water outlet region can be designed in the form of a grid or in slotted form by means of small openings and can merge flush into the sliding surface.

An exit section is preferably provided at the starting point of the loop section. Said exit section is not designed as a closed tube but rather, for example, as a half shell, or, in the case of a closed tube, has at least one exit opening outside the sliding surface. It is thereby possible to provide an exit possibility for individuals who have not reached the required rising height as far as the apex and slide back to the starting point of the loop section.

Furthermore, it is preferably provided that a loop radius or radius of curvature of a subsequent loop section is designed to be smaller that that of the preceding loop section. This ensures that the sliding individual still has sufficient speed in order to slide through the second or further, subsequent loop section.

Furthermore, it is preferably provided that an angle of inclination of a subsequent loop section is designed to be greater than that of the preceding loop section with respect to the vertical. By means of the angle of inclination becoming more shallow, the one or more subsequent loop sections can be travelled through at a reduced sliding speed without the looping-the-loop effect for the user being lost.

Furthermore, it is preferably provided that a first loop section and at least one subsequent loop section are inclined in a mirror-inverted manner with respect to the vertical. By means of such a V-shaped orientation of at least two loop sections in a row next to each other, an increased sensation of thrill can be created by a further change in direction. As an alternative, it can be provided that two or more loop sections are preferably inclined at the same angle in relation to the vertical.

According to a further preferred embodiment, it is provided that, for example, a first loop section comprises a lower apex point than a subsequent loop section. Different sliding speeds can thereby be obtained and therefore the sensation of thrill increased.

In order to monitor the water slide having at least one loop section, it is preferably provided that at least one monitoring sensor is provided at the apex point of the loop section or at the end of the discharge section and activates a signal device, which is provided at the entry, to indicate that the chute is free. This makes it possible to create a controlled and monitored water slide which monitors those regions of the water slide which can not be seen into.

According to a preferred configuration of the invention, it is provided that a rising and a falling section of the loop section are inclined within a common angular range with respect to the vertical. As a result, a "loop-type looping the loop" is formed. If the orientation of a plurality of loop-type loopings the loop opposed to the vertical is provided, "butterfly-type loopings the loop" are formed.

According to a further alternative configuration of the invention, it is provided that a rising and a falling section of the loop section are inclined within an angular range in a mirror-inverted manner with respect to the vertical 22. In the case of such a loop section, a chute profile imitating a turn of a thread is obtained. Such an embodiment is referred to as "helical looping the loop".

BRIEF DESCRIPTION OF THE DRAWINGS

The invention and further advantageous embodiments and developments of the same are described and explained in more detail below with reference to the examples illustrated in the drawings. The features to be gathered from the description and the drawings can be used, according to the invention, individually by themselves or a number of them can be used in any desired combination. In the drawings.

DETAILED DESCRIPTION OF THE INVENTION

Figure 1C:
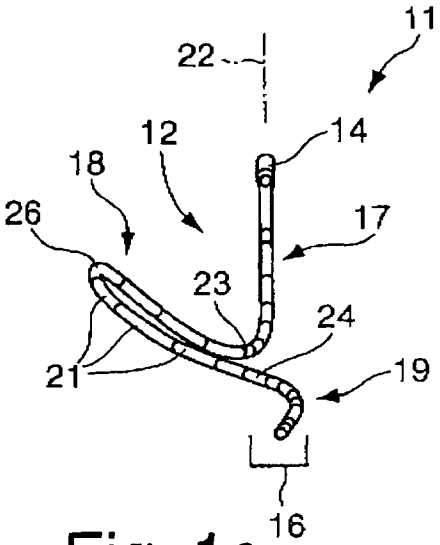
FIGS. 1*a-d* show schematic views of a first embodiment of the water slide.
Figure 1A:
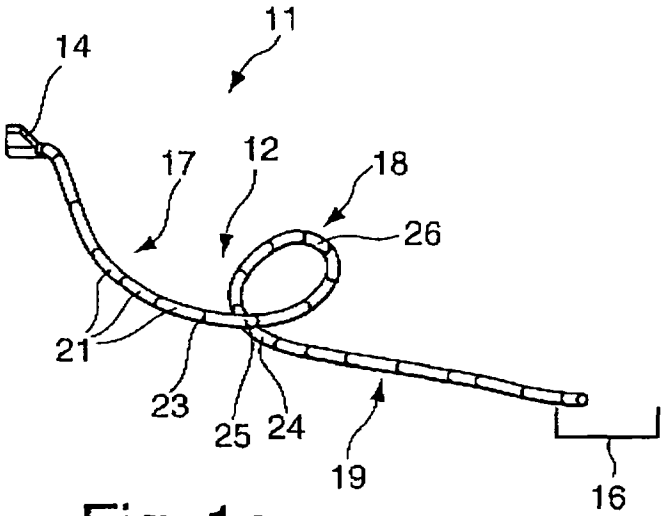

FIGS. 1*a-d* illustrate a first embodiment of a water slide 11 according to the invention. FIG. 1*a* illustrates a side view of a water slide 11. Said water slide 11 comprises a chute 12 which extends from a starting ramp 14 as far as a discharge area 16

(illustrated schematically). Said discharge area 16 can be formed by a water basin or a braking section or as a landing zone. The chute 12 comprises an initial section 17 which adjoins the starting ramp 14, merges into a loop section 18 and opens into a discharge section 19 which ends at the discharge area 16.

Figure 1D:
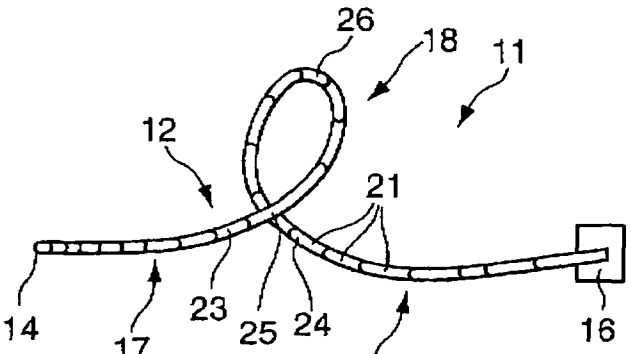
Figure 1B:
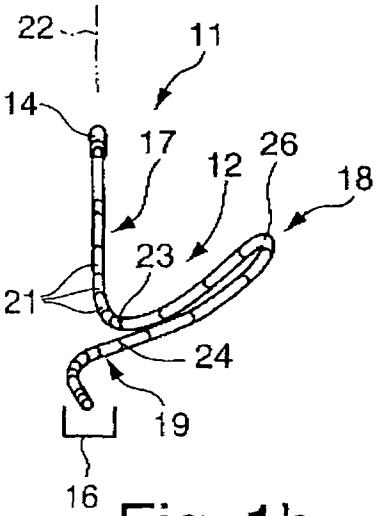
Figure 2C:
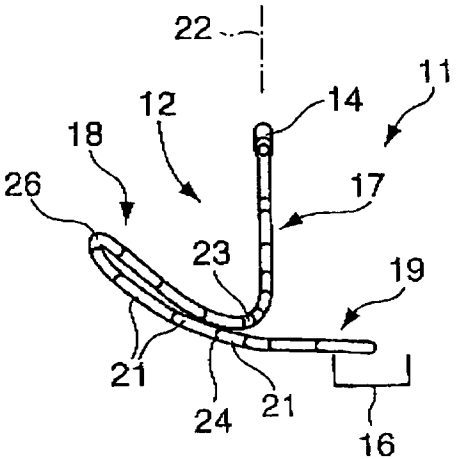
FIGS. 2*a-d* show schematic views of an alternative embodiment of a water slide.
Figure 2A:
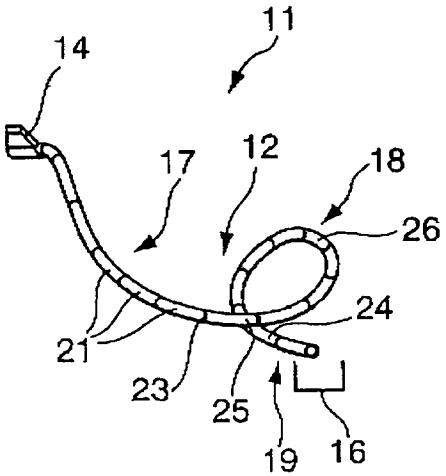
Figure 2D:
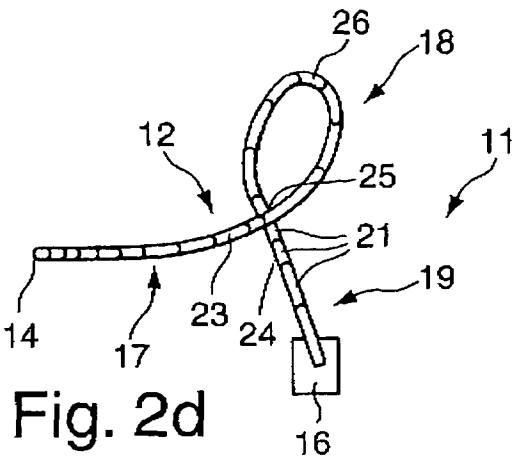
Figure 2B:
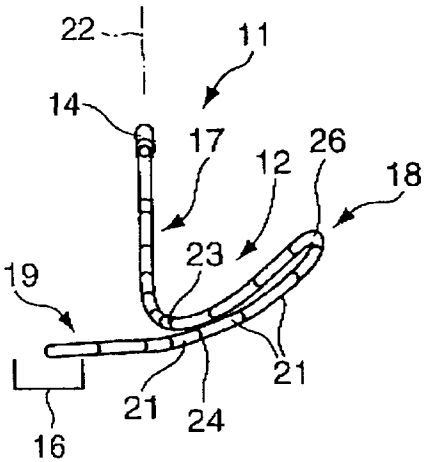
Figure 3C:
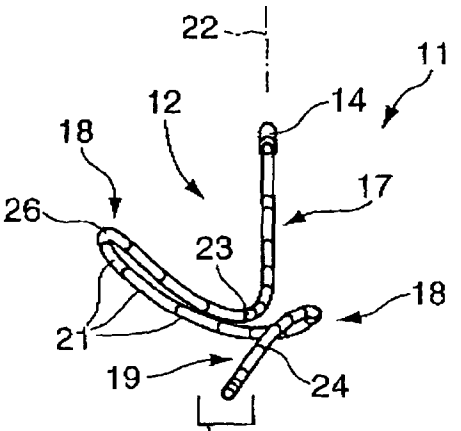
FIGS. 3*a-d* show schematic views of a further alternative embodiment of a water slide.
Figure 3A:
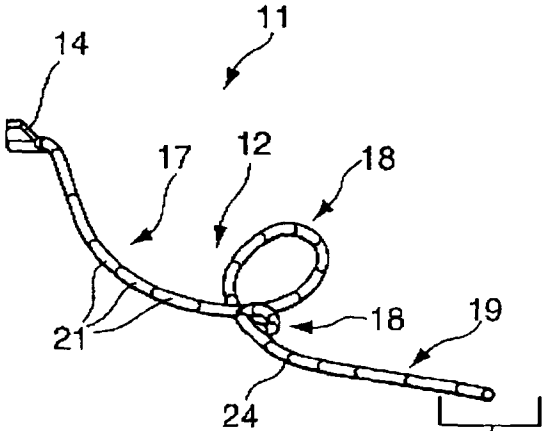
Figure 3D:
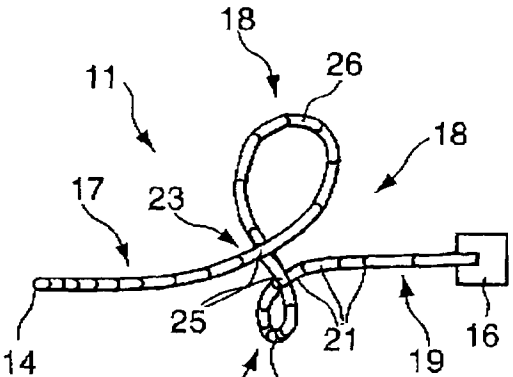
Figure 3B:
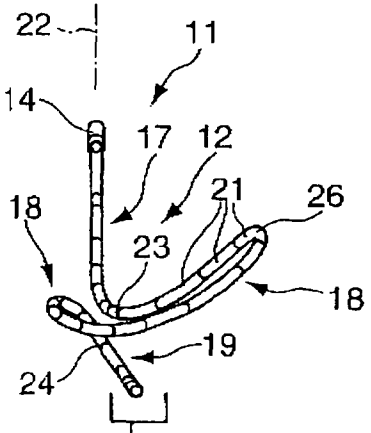
Figure 4C:
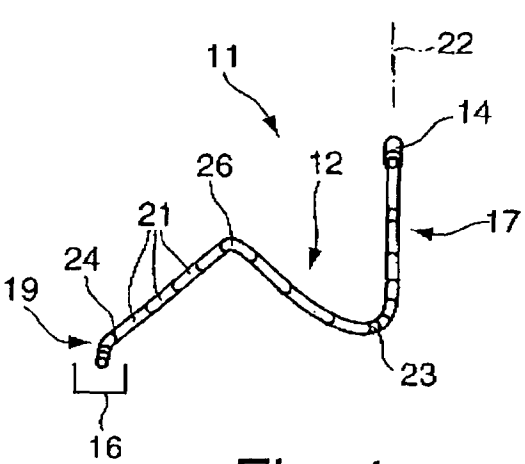
FIGS. 4*a-d* show schematic views of a further alternative embodiment of a water slide.
Figure 4A:
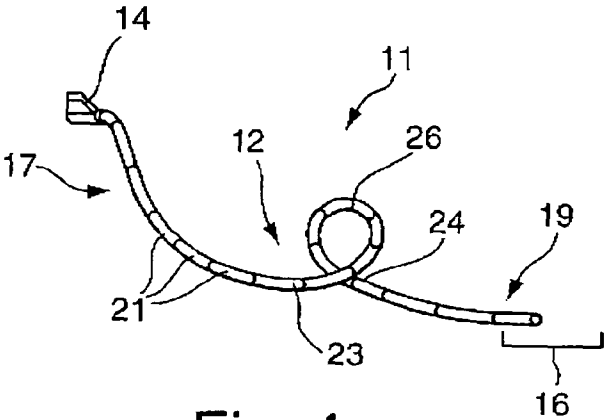
Figure 4B:
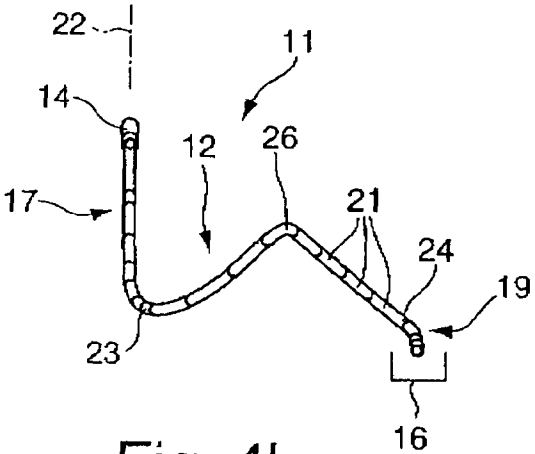
Figure 4D:
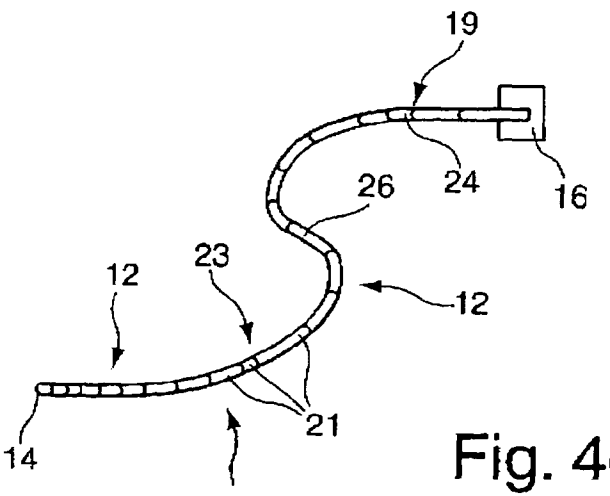

FIG. 1*b* shows a schematic front view, FIG. 1*c* shows a schematic view from the rear and FIG. 1*d* shows a schematic view from above of the water slide 11. This embodiment is referred to as "loop-type looping the loop".

The chute 12 is assembled from individual chute segments 21 which are connected to one another via releasable flange connections. The chute segments 21 may have a rectilinear or curved profile in order, after a plurality of chute segments 21 are put together, to obtain the desired chute profile. The chute segments 21 are preferably designed as closed tubes. The sliding surface of the chute 12 is wetted by a water or spray mist so that the frictional resistance is kept low in order to obtain a low frictional force or sliding friction. The chute segments 21 are preferably designed as plastic tubes, in particular glass-fibre-reinforced plastic tubes, which are of translucent or opaque design. As an alternative, the plastic tubes may also be formed from a transparent plastic, such as, for example, PMMA or PC.

In FIGS. 1*a* to 1*d*, the loop section 18 between the initial section 17 and the discharge section 19 comprises an angle at circumference of at least 270°, with it being provided that the discharge section 19 constitutes an extension of the initial section 17 and is oriented in the same direction as the initial section 17. In the exemplary embodiment, the loop section 18 is inclined by approx. 60 to 70° in relation to a vertical 22. Starting from a starting point 23, which forms the transition between the initial section 17 and the loop section 18, as far as a discharge point 24, which forms the transition from the loop section 18 to the discharge section 19, the chute profile of the loop section 18 has a radius of curvature which is preferably composed of a circular chute and a clothoid chute. In this case, a rising section between the starting point 23 and an apex point 26 of the loop section 18 is preferably provided symmetrically to a subsection from the apex point 26 as far as the discharge point 24. This curved profile of the loop section 18 makes it possible for a maximum permissible centrifugal force acceleration not to be exceeded and for a person of average body weight to slide through the loop section 18 upside down at the apex point 26. Furthermore, by the loop section 18 being inclined in relation to the vertical 22, it is possible for individuals who only build up a small sliding speed from the starting ramp 14 in the initial section 17 to experience a rollercoaster-type ride and to pass via the discharge section 19 to the discharge area 16. Accordingly, versatile use can be provided by such a transversely inclined loop section 18 or looping-the-loop section. Furthermore, it is possible for individuals who do not have a speed surplus sufficient to pass through the apex point 26 to leave the chute 12 at an exit point after sliding back to the starting point 23.

The loop section 18 is composed, for example, of eight chute segments 21. These radii are preferably constant within the circular portion or the arc segment. During the transition from one circular portion into the adjacent circular portion of the chute segments 21, a centrifugal force of less than 1 g may briefly occur. However, because of the speed surplus, this is not a problem. On the contrary, this may create an increased sensation of thrill.

The combining of the circular and clothoid chute profile results, in particular after the initial section 17, in loadings, for example of greater than 2.6 g, not occurring in the rising section of the loop section 18. The same applies to the falling section directly in the transition to the discharge section 19.

A water slide 11 of this type, which is illustrated in FIGS. 1*a-d*, has, for example a radius of the loop section 18 of approx. 3 m. Preferred entry speeds into the loop section 18 amount to approx. 50 to 60 km/h which are generally obtained with a starting height of 12 to 14 m in relation to the starting point 23 of the loop section 18.

FIGS. 2*a-d* illustrate an alternative embodiment of the water slide 11. In this alternative embodiment, the discharge section 19 is oriented differently from the initial section 17. For example, the discharge section 19 is oriented within an angular range of between 70 and 110° with respect to the initial section 17. This embodiment of the water slide 11 shows that a loop section 18 which comprises a transverse inclination can nevertheless be formed. The chute profile can be of flexible design because of the different directions of the discharge sections 19 in comparison to the initial sections 17.

The loop section 18 has an intersecting point between the rising and the falling section, with the angle at circumference situated in between being, for example, within a range of between 260 and 290°. As a result, the loop section 18 has, as seen in plan view, a shape which corresponds to a "half twist".

FIGS. 3*a-d* illustrate a further alternative embodiment of the invention which is referred to as "butterfly-type looping the loop". In this embodiment, two loop sections 18 are arranged in a row directly next to each other between the initial section 17 and the discharge section 19. The first loop section 18 corresponds to that in FIG. 2. The second loop section 18 is preferably inclined in a mirror-inverted manner in relation to the vertical 22 and with respect to the first loop section 18. As an alternative, the second loop section 18 may also comprise the same transverse inclination direction as the first loop section 18. The second loop section 18 preferably has the same inclination or a greater inclination in relation to the vertical 22 as/than the first loop section 18. As a result, losses in speed which may arise because of the sliding friction in the transition region between the first and second loop sections 18 can be compensated for and sliding upside down can be maintained.

The orientation and size of the first and second loop sections 18 are merely by way of example. It goes without saying that a plurality of loop sections 18 can also be provided between an initial section and discharge section, with it being possible for said loop sections 18 to comprise either the same direction of inclination or a mirror-inverted direction of inclination with respect to the vertical 22 or different inclinations and loop radii. Furthermore, it is also possible for "calming" or transition sections to be provided between the individual loop sections or in one loop section, which calming or transition sections comprise a greater distance between the two loop sections to be connected. Furthermore, it is possible for the apex point of a second or subsequent loop section 18 to be higher than the apex point in a first or preceding loop section 18.

FIGS. 4*a* to *d* illustrate a further alternative embodiment of a water slide 11. Such an embodiment and its geometry are also referred to as "helical looping the loop". This embodiment differs, for example, from the embodiment according to FIG. 1 in that the starting point 23 and discharge point 24 do not lie directly adjacent to each other but rather are arranged at a greater distance from each other such that the loop section 18 corresponds to the profile of a screw thread. The starting point 23 and the discharge point 24 are spaced apart from each other as a function of the pitch. Such loop sections 18 permit sliding upside down and also a roller coaster-type ride if the entry speed into the loop section 18 should not be of a sufficient magnitude. In the case of such a loop section, the rising and falling section are arranged at the same angle with respect to the vertical 22, as is revealed, for example, in FIGS. 4*b* and *c*. As an alternative, one of the two sections may be arranged at a greater or smaller angle with respect to the vertical 22 or with respect to the apex point 26.

All of the abovementioned features are in each case essential to the invention by themselves and may be combined with one another as desired.

The invention claimed is:

1. Water slide with a chute which opens into a discharge area and has an initial section and a discharge section opening into the discharge area, characterized in that at least one loop section is provided between the initial section and the discharge section, said loop section having an angle at circumference of at least 270° and, at least between a starting point and an apex point of the loop section, being inclined by 5° to 80° in relation to a vertical.

2. Water slide according to claim 1, characterized in that a radius of curvature decreases from the starting point to the apex point of the loop section.

3. Water slide according to claim 1, characterized in that the loop section has, from the starting point as far as the apex point, a radius of curvature which is formed from a combination of a chute profile for circular looping the loop and clothoid looping the loop.

4. Water slide according to claim 3, characterized in that the loop section from the apex point to the discharge point has a mirror-inverted profile to the chute profile from the starting point as far as the apex point.

5. Water slide according to claim 1, characterized in that the loop section of a sliding surface of the chute is provided with a minimum radius of at least 2 m at the starting point as far as the apex point.

6. Water slide according to claim 1, characterized in that the chute is completely closed at least along the loop section.

7. Water slide according to claim 1, characterized in that a sliding surface of the chute is circular, as seen in cross section.

8. Water slide according to claim 1, characterized in that a sliding surface of the chute has a profile for guiding the sliding individual.

9. Water slide according to claim 1 characterized in that a sliding surface of the chute has a trough-shaped depression, as seen in cross section.

10. Water slide according to claim 1, characterized in that a sliding surface of the chute has a rectilinear profile which is adjoined laterally by lateral guiding walls in order to bound the sliding surface.

11. Water slide according to claim 1, characterized in that a sliding surface of the chute is at least partially acted upon by a water film, rainfall or spray mist along the loop section in the region of the upside down sliding surface.

12. Water slide according to claim 1, characterized in that a sliding surface of the chute is at least partially acted upon by a water film, rainfall or spray mist in the region of the upside down sliding surface.

13. Water slide according to claim 1, characterized in that a water outlet region is integrated in the sliding surface at the starting point of the loop section.

14. Water slide according to claim 1, characterized in that an exit section is provided at the starting point of the loop section.

15. Water slide according to claim 1, characterized in that a loop radius of a subsequent loop section is designed to be smaller than that of the preceding loop section.

16. Water slide according to claim 1, characterized in that an angle of inclination in relation to the vertical of a subsequent loop section is designed to be greater than that of the preceding loop section.

17. Water slide according to claim 1, characterized in that a first loop section and at least one subsequent loop section are inclined in a mirror-inverted manner with respect to the vertical.

18. Water slide according to claim 1, characterized in that at least one monitoring sensor is provided at the apex point of the loop section or at the end of the discharge section of the chute and activates a signal device, which is provided at the entry, to indicate that the chute is free.

19. Water slide according to claim 1, characterized in that a rising and a falling section of the loop section are inclined within a common angular range in relation to the vertical.

20. Water slide according to claim 1, characterized in that a rising and a falling section of the loop section are inclined at an angle in a mirror-inverted manner with respect to the vertical.

* * * * *